US010189488B2

(12) United States Patent
Clark

(10) Patent No.: US 10,189,488 B2
(45) Date of Patent: Jan. 29, 2019

(54) RAILWAY FREIGHT CAR DRAFT GEAR ASSEMBLY

(71) Applicant: Amsted Rail Company, Inc., Chicago, IL (US)

(72) Inventor: Marlin E. Clark, Collinsville, IL (US)

(73) Assignee: AMSTED RAIL COMPANY, INC., Chicago, IL (US)

( * ) Notice: Subject to any disclaimer, the term of this patent is extended or adjusted under 35 U.S.C. 154(b) by 11 days.

(21) Appl. No.: 15/255,440

(22) Filed: Sep. 2, 2016

(65) Prior Publication Data

US 2018/0065649 A1 Mar. 8, 2018

(51) Int. Cl.
*B61G 9/00* (2006.01)
*B61G 9/04* (2006.01)
*B61G 9/20* (2006.01)

(52) U.S. Cl.
CPC ..... *B61G 9/04* (2013.01); *B61G 9/20* (2013.01)

(58) Field of Classification Search
CPC .... B61B 9/00; B61B 9/02; B61B 9/04; B61B 9/06; B61B 9/08; B61B 9/20; B61G 9/00; B61G 9/02; B61G 9/04; B61G 9/06; B61G 9/08; B61G 9/20
See application file for complete search history.

(56) References Cited

U.S. PATENT DOCUMENTS 2,303,915 A * 12/1942 Dentler ..... B61G 9/045 213/47
2,390,496 A * 12/1945 Campbell ..... B61G 9/045 213/45
2,408,195 A * 9/1946 Campbell ..... B61G 9/10 213/32 R
2,474,919 A * 7/1949 Spence ..... B61G 9/06 213/46 R
2,776,057 A * 1/1957 Blattner ..... B61G 9/06 213/41

(Continued)

OTHER PUBLICATIONS

Association of American Railroads Manual of Standards and Recommended Practices, Standard S-239, "Draft Arrangement, E60 Coupler, 24 5/8 in. Pocket-Striker Applied by Welding," last revised 2012, 1 page.

(Continued)

*Primary Examiner* — Jason C Smith
(74) *Attorney, Agent, or Firm* — Amsted Industries Incorporated

(57) ABSTRACT

A draft gear assembly for use with railcars having coupler members is provided. The draft gear assembly has front and back ends and comprises a yoke, a coupler follower, a front resilient member, an intermediate stop member, and a back resilient member. The yoke has a back wall, a top wall extending from the back wall toward the front end of the draft gear assembly, and a bottom wall extending from the back wall toward the front end of the draft gear assembly. The coupler follower is positioned between the butt end of the coupler shank and the front end of the draft gear assembly. The front resilient member is positioned between the coupler follower and the intermediate stop member. The back resilient member is positioned between the intermediate stop member and the yoke back wall. The front and back resilient members are compressible.

12 Claims, 2 Drawing Sheets

(56) References Cited

U.S. PATENT DOCUMENTS

| | | | | |
|---|---|---|---|---|
| 2,781,135 | A * | 2/1957 | Willison | B61G 9/06 213/40 R |
| 2,791,337 | A * | 5/1957 | Blattner | B61G 9/06 213/45 |
| 2,801,010 | A * | 7/1957 | Willison | B61G 9/06 213/45 |
| 2,929,518 | A * | 3/1960 | Blattner | B61G 9/06 213/41 |
| 5,312,007 | A * | 5/1994 | Kaufhold | B61G 7/10 213/50 |
| 5,931,101 | A | 8/1999 | Kaufhold et al. | |
| 6,199,708 | B1 | 3/2001 | Monaco | |
| 6,360,906 | B1 | 3/2002 | Kaufhold et al. | |
| 6,446,820 | B1 | 9/2002 | Barker et al. | |
| 6,986,432 | B2 | 1/2006 | Limbach et al. | |
| 2002/0070189 | A1 * | 6/2002 | Barker | B61G 9/06 213/62 R |
| 2008/0272081 | A1 * | 11/2008 | Sprainis | B61G 9/06 213/40 R |
| 2011/0253663 | A1 * | 10/2011 | Liu | B61G 9/06 213/75 R |
| 2015/0307115 | A1 * | 10/2015 | Wang | B61G 9/06 213/47 |

OTHER PUBLICATIONS

Association of American Railroads Manual of Standards and Recommended Practices, Standard S-245, "Draft Arrangement, F70 Coupler, 24 5/8-in. Pocket-Striker Applied by Welding," last revised 1978, 1 page.

* cited by examiner

RAILWAY FREIGHT CAR DRAFT GEAR ASSEMBLY

BACKGROUND OF THE INVENTION

The present invention relates to railway freight car coupling systems, and, more particularly, to draft gear assemblies used in conjunction with draft sills and couplers in railway freight cars.

Draft gear assemblies are utilized as part of the connection between the couplers at the ends of adjoining railway freight cars and the draft sills at the ends of the railway freight cars. The draft sills are commonly cast steel or fabricated steel structures that are mounted at the ends of the center sills of the railway freight car. The draft sills have a pair of front stops and a pair of rear stops, with a draft gear pocket formed between the front and rear stops. A draft gear assembly is received in the draft gear pocket.

Each draft gear assembly is connected to a coupler shank, with coupler heads of adjacent rail cars connected to form the train. The train may be up to one hundred or more cars long and drawn by one or more locomotives. Typically, there is a limited amount of slack or free movement allowed between the cars; typically there is about two (2) inches of slack between adjacent railway freight cars. This slack allows the railway freight cars limited movement toward each other in response to buff or impact events which usually occur during train deceleration and away from each other in response to draft events which usually occur during train acceleration.

Train deceleration usually subjects the couplers of the cars to buff impacts, and train acceleration usually subjects the couplers of the cars to draft impacts. These impacts are transmitted from the couplers to the draft gear assemblies to the rail car body. That is, as the couplers are pulled or pushed, the movement is translated to the freight car body through the draft gear assemblies. Typical draft gear assemblies include a draft sill housing in which all the components of the draft gear assembly are fitted in what is deemed a draft gear pocket, a yoke element within the draft sill that is connected to the coupler through a pin or key, a coupler follower and a draft gear, as well as other elements. Generally, the coupler follower is positioned against or closely spaced from the butt end of the coupler in the draft gear pocket, within the yoke. The draft gear is positioned between the coupler follower and the rear stops of the draft sill; other elements, such as a wedge, may be interposed between the draft gear and the coupler follower.

In buff events, the butt end of the coupler moves inward against the coupler follower toward the rear stops of the draft sill. As the coupler and coupler follower are moved rearward, the shock of the movement is transferred to the draft gear. The draft gear typically absorbs and dissipates some of the energy from this shock through friction.

In draft events, slack is taken up between adjacent cars beginning at one end of the train and ending at the other end of the train. As a result of the slack being progressively taken up, the speed differences between the railcars increases as the slack at each coupler pair is taken up, with a resultant increase in buff and draft impacts on the couplers. For instance, during locomotive acceleration of a 100 car train from rest there may be a total of 200 inches of slack between the 100 pairs of couplers in the train. This slack is taken up progressively, coupler pair by coupler pair. When the 2 inch slack in the coupler pair joining the last car to the train is taken up the next to the last car may be moving at a speed of 4 miles per hour. The slack in the last coupler pair is taken up very rapidly and the last two cars are subjected to a very large impact capable of injuring the lading or the car.

Various types of draft gear assemblies have been proposed and used. Some draft gear assemblies employ mechanical springs and steel friction members held in a steel housing that is received in a yoke. Other draft gear assemblies employ elastomer springs. However, those employing a steel housing add to the weight of the railcar. Those employing elastomer springs may be difficult to install and remove from standard draft sills.

In exceptionally heavy duty railway freight car service, such as in captive mining service wherein individual gross railway car loading may exceed 286,000 pounds, there have been concerns relating to the performance of draft gear assemblies. There is a limited amount of space available in the railway freight car draft gear pocket to accommodate the draft gear assembly. Accordingly, the draft gear assembly and its inherent performance are limited by the space available in the draft gear pocket. In typical railway freight cars, the draft gear pocket cross sectional dimensions are approximately 8 and ⅞ inches by 12 and ½ inches, for a typical cross section of approximately 111 square inches. The force per unit area to which the draft gear assembly is exposed is accordingly the compressive pound force divided by the cross sectional dimension. For example, a 300,000 pound buff force divided by the nominal 111 square inch cross sectional dimension would result in a force on the draft gear assembly of 2702 pounds per square inch. The unit loading is prescribed by the physical dimensions of the draft gear pocket. Accordingly, it is an object of the present invention to provide reduced unit loading within the standard draft gear pocket physical dimensions.

SUMMARY OF THE INVENTION

In one aspect, the present invention provides a draft gear assembly for use with railcars having coupler members. The draft gear assembly has front and back ends and comprises a yoke, a coupler follower, a front resilient member, an intermediate stop member, and a back resilient member. The yoke has a back wall, a top wall extending from the back wall toward the front end of the draft gear assembly, and a bottom wall extending from the back wall toward the front end of the draft gear assembly. The coupler follower is positioned between the butt end of the coupler shank and the front end of the draft gear assembly. The front resilient member is positioned between the coupler follower and the intermediate stop member. The back resilient member is positioned between the intermediate stop member and the yoke back wall. The front and back resilient members are compressible.

A coupler extends forward from the yoke with a coupler shank butt end in contact with the coupler follower. The coupler and actually the entire draft gear assembly has a neutral position, a draft stroke from the neutral position to a full draft position forward of the neutral position and a buff stroke from the neutral position to a full buff position back from the neutral position. The coupler and yoke have draft strokes such that the distance between the front face of the yoke back wall and the coupler follower decreases from the neutral spacing when the coupler is in the full draft position and the distance between the rear face of the yoke back wall and the rear follower increases from the neutral spacing when the coupler is in the full draft position. The coupler, yoke and coupler follower have buff strokes such that the distance between the front face of the yoke back wall and the coupler follower decreases from the neutral spacing when the coupler is in the full buff position and the distance between the rear face of the yoke back wall and the rear follower decreases from the neutral spacing when the coupler is in the full buff position.

In another aspect, the present invention provides in combination, a draft gear assembly, a coupler and a draft sill. The draft sill has a pair of front stops and a pair of rear stops that in essence define the draft gear pocket. The draft gear assembly has front and back ends and comprises a yoke having a back wall, a top wall extending from the back wall toward the front end of the draft gear assembly, and a bottom wall extending from the back wall toward the front end of the draft gear assembly. The back wall of the yoke is between the front and rear stops of the draft sill. A coupler follower is positioned between the back wall of the yoke and the front stops of the draft sill. A rear follower is longitudinally spaced from the yoke back wall. At least one front resilient member fills the longitudinal distance between the coupler follower and the back wall of the yoke. At least one back resilient member fills the longitudinal distance between the rear follower and the back wall of the yoke. An intermediate stop member is located between the front resilient member and the back resilient member. A coupler shank extends forward from the yoke. The coupler and actually the entire draft gear assembly has a neutral position, a full draft position forward of the neutral position and a full buff position back from the neutral position.

In a buff load, the loading on each of the front resilient member and the back resilient member is shared as if the front resilient member and the back resilient member are in parallel due to the presence of the intermediate stop member. Buff compression of the front resilient member will cause stops on the intermediate stop member to contact the back resilient member and accordingly, the compressive strength of the front resilient member and the back resilient member act as if the front and back resilient members are in parallel. Of course, the limited area in a typical railway freight car draft gear pocket would not allow two draft gear resilient members to be positioned side by side to act in parallel. The unique and inventive draft gear assembly of the present invention utilizing a front resilient member and a back resilient member with an intermediate stop member there between allows the front and rear resilient members to fit in the draft gear pocket and act as if they are in parallel for force absorbing properties.

DETAILED DESCRIPTION

Figure 1:
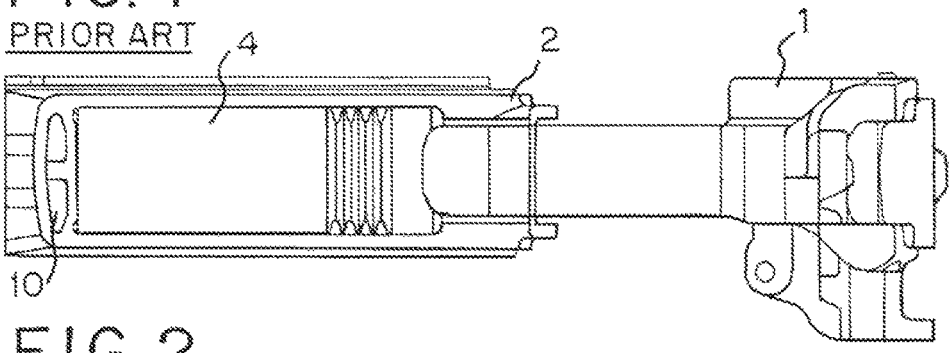
FIG. 1 PRIOR ART
FIG. 1 is a side view of a prior art coupler and draft gear in a neutral position.
Figure 2:
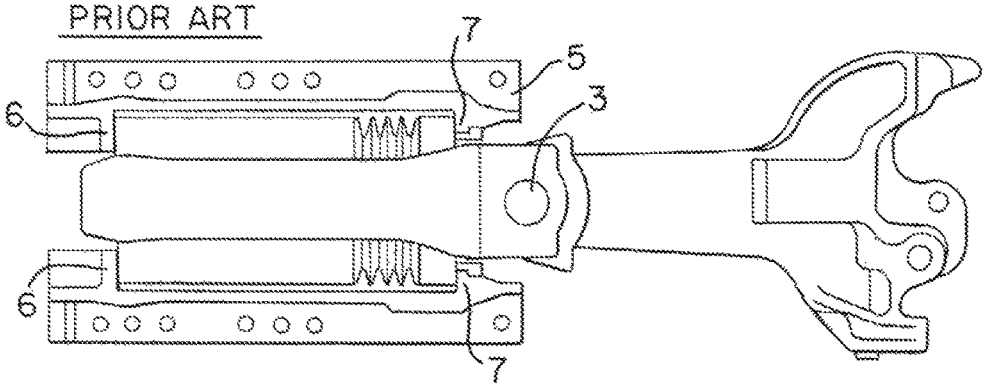
FIG. 2 PRIOR ART
FIG. 2 is a top view of a prior art coupler and draft gear in a neutral position.
Figure 3:
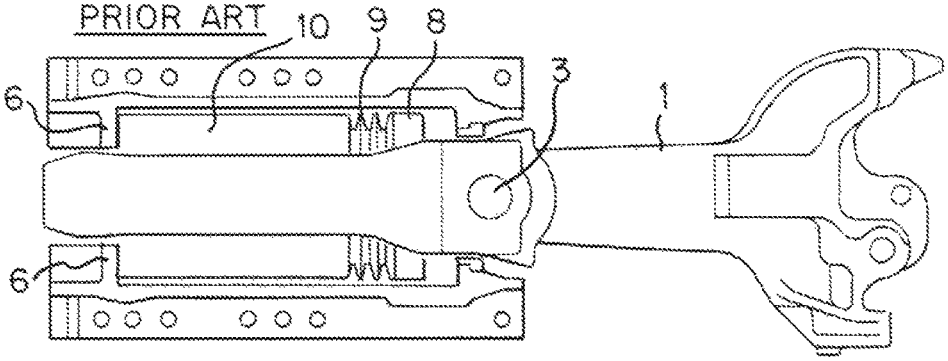
FIG. 3 PRIOR ART
FIG. 3 is a top view of a prior art coupler and draft gear in a buff position.
Figure 4:
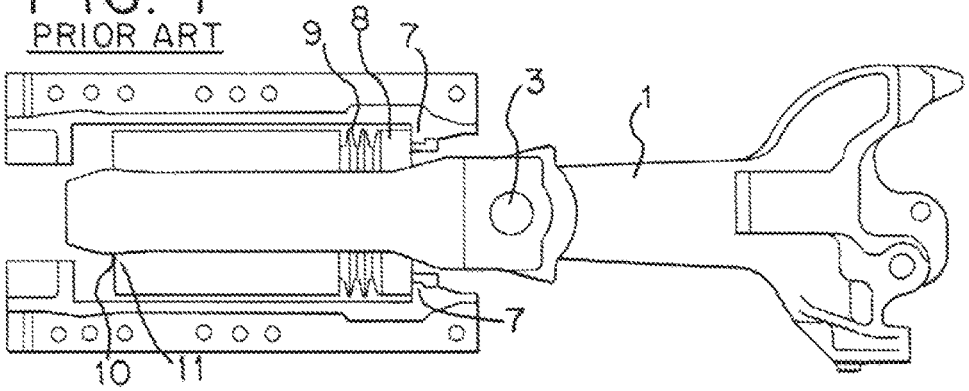
FIG. 4 PRIOR ART
FIG. 4 is a top view of a prior art coupler and draft gear in a draft position.

Referring to FIGS. 1-4,

Each end of a railroad freight car utilizes a coupler 1 that allows it to be coupled to an adjacent railcar. The coupler 1 is connected to a yoke 2 by a pin 3. A known draft gear 4 is fitted inside the yoke 2. This coupler, yoke, draft gear assembly is fitted into a draft sill 5 which is part of the railcar underframe—at each end of the railcar. The assembly fits between buff (push) stops 6 and draft (pull) stops 7. The draft gear acts as a shock absorber during buff (push) and draft (pull) movements of the connections between railcars. In the existing art, the draft sill and yoke are constructed to be fitted with a single draft gear.

In a buff (push) movement between railcars, the coupler 1 which is constructed with an elongated pin hole so as to not load the pin 3, engages the draft gear follower 8 compressing a spring/friction elements or elastic elements 9 into the draft gear rear follower 10 and finally into the rear buff (push) stops 6 transferring the buff load into the railcar underframe structure.

In a draft (pull) movement between railcars, the coupler 1 engages the pin 3 pulling the yoke until its rear portion 10 engages the rear follower of the draft gear 11 compressing springs/friction elements or elastic elements 9 into the draft gear front follower 8 engaging the draft (pull) stops 7 transferring the draft load to the railcar underframe structure.

In the existing art, the load carrying capacity of the draft gear is limited by the physical dimensions (width and height) of the draft gear pocket. The fitting of additional springs in the draft gear increases draft gear stroke—but not the load carrying capacity.

Figure 5:
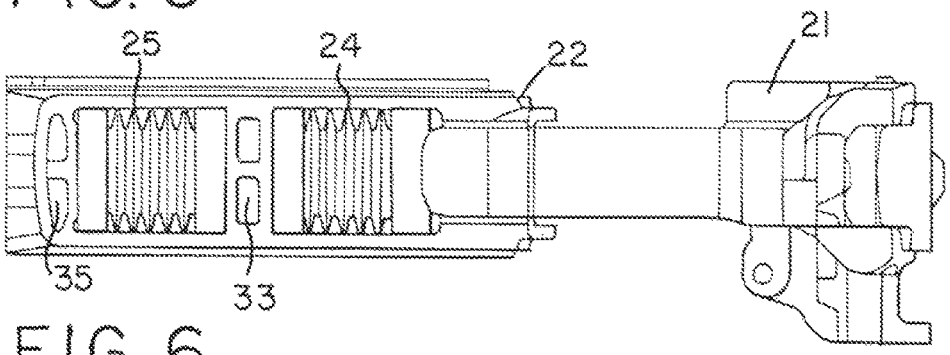
FIG. 5 is a side view of a coupler and draft gear in accordance with an embodiment of the present invention in a neutral position.
Figure 6:
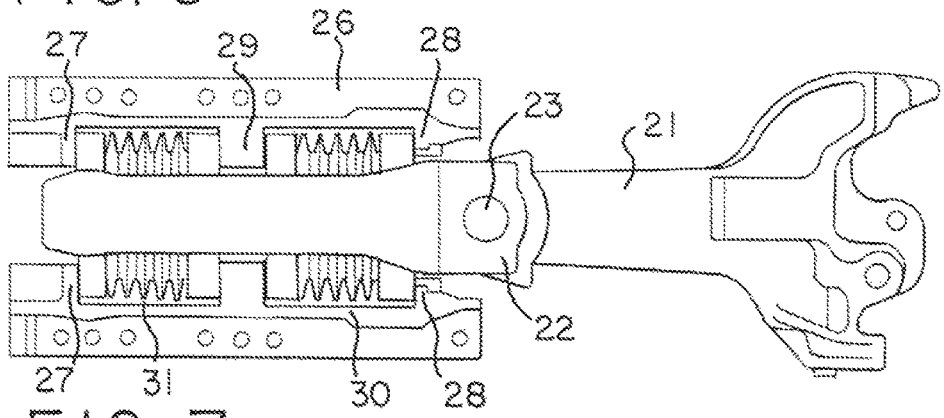
FIG. 6 is a top view of a coupler and draft gear in accordance with an embodiment of the present invention in a neutral position.
Figure 7:
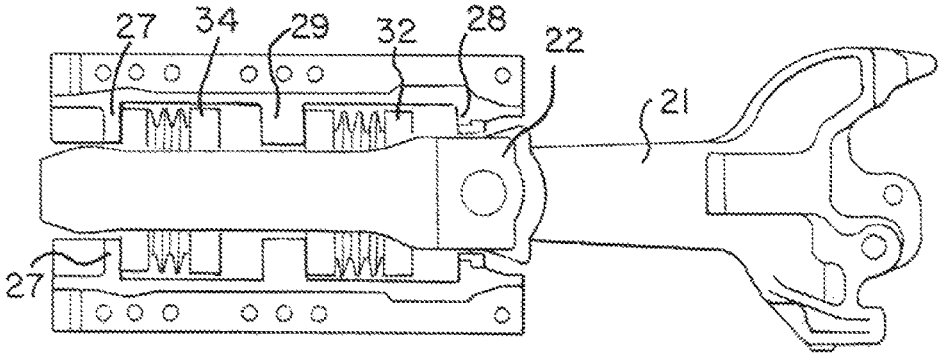
FIG. 7 is a top view of a coupler and draft gear in accordance with an embodiment of the present invention in a buff position.
Figure 8:
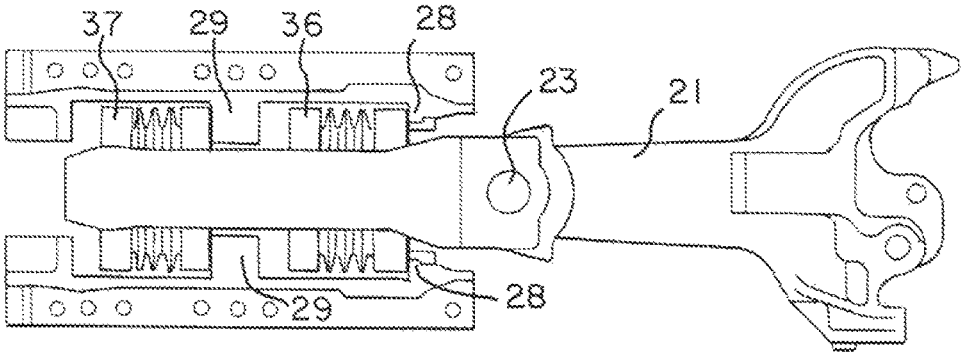
FIG. 8 is a top view of a coupler and draft gear in accordance with an embodiment of the present invention in a draft position.

Referring now to FIGS. 5-8, a preferred embodiment of the present invention will now be described.

Each end of a railroad freight car utilizes a coupler 21 that allows it to be coupled to an adjacent railcar. The coupler 21 is connected to a tandem (two pocket) yoke 22 by a pin 23.

The yoke is constructed with two (tandem) draft gear pockets separated by a yoke intermediate stop 33 and fitted with two tandem draft gears 24 and 25. The coupler, yoke and draft gears assembly is fitted into a draft sill 26 which is part of the railcar underframe structure at both ends of the railcar. The assembly fits between buff (push) stops 27 and draft (pull) stops 28. In the invention, a new pair of intermediate stops 29 are added to the pocket to form two separate draft gear pockets 30 and 31 to accommodate the tandem draft gears 24 and 25.

In a buff (push) movement between railcars, the coupler 21 which is constructed with an elongated pin hole so as to not load the pin 23, engages the draft gear 24 front follower 32 driving the yoke 22 towards the rear of the draft pocket compressing draft gear 24 into the intermediate stop 29. At the same time, the intermediate stop 33 in the yoke engages the front follower 3 4 of draft gear 25 compressing it into the rear stops 27.

In a draft (pull) movement between railcars, the coupler 21 engages the pin 23 pulling the yoke intermediate stop 33 into the rear follower 36 of draft gear 24 compressing the draft gear into the draft stop 28 At the same time, the rear portion of the yoke 22 engages the rear follower 37 of draft gear 25 compressing it into the intermediate stop 29.

In operation, the tandem draft gears act independently effectively putting them in parallel. The independent parallel operation of the tandem draft gears effectively reduces the unit loading on the draft gears by 50% thereby increasing draft gear life and increasing load carrying capacity over a single draft gear by 100%.

What is claimed is:

1. A draft gear assembly for use with railway freight cars, the draft gear assembly having a front end and a back end and comprising:

a draft sill;

a yoke having a rear wall and being shiftable relative to the draft sill between a buff position, a neutral position, and a draft position, a front draft gear adjacent a butt end of a coupler shank, the front draft gear including a front follower, a back follower, and a front resilient member therebetween;

a back draft gear adjacent the rear wall of the yoke, the back draft gear including a front follower, a back follower, and a back resilient member therebetween, an intermediate stop member between the front draft gear and the back draft gear, a yoke intermediate stop of the yoke between the front draft gear and the back draft gear, the yoke intermediate stop being shiftable relative to the intermediate stop member with shifting of the yoke between the buff position, neutral position, and draft position;

the front resilient member and the back resilient member being compressible, the draft sill having front stops, the front draft gear including a front stop surface for contact with the draft sill front stops, the draft sill having rear stops, the back draft gear including a back stop surface for contact with the draft sill rear stops, the front draft gear including a back stop surface contacting the yoke intermediate stop with the yoke in the neutral position, and the back draft gear including a front stop surface contacting the yoke intermediate stop with the yoke in the neutral position.

2. The draft gear assembly of claim 1, wherein the front draft gear front stop surface contacting the draft sill front stops during a draft condition of the draft gear assembly, and the back draft gear back stop surface contacting the draft sill rear stops during a buff condition of the draft gear assembly.

3. The draft gear assembly of claim 1, wherein the back stop surface of the front draft gear contacting the intermediate stop member during a buff condition of the draft gear assembly, the back draft gear includes a front stop surface, and the yoke intermediate stop contacting the back draft gear front stop surface during a buff condition of the draft gear assembly.

4. The draft gear assembly of claim 3 wherein the front and back draft gears are compressed during a buff condition with a buff force being applied to the front draft gear by contact with the coupler shank, and the buff force being applied to the back draft gears by contact between the back draft gear and the yoke intermediate stop, such that the resilient members of the front and back draft gears being compressed during the buff condition such that a total compressive strength of the front resilient member and the back resilient member is the compressive strength of the front resilient member added to the compressive strength of the back resilient member.

5. The draft gear assembly of claim 1, wherein the intermediate stop member comprises an outer body structure of a generally elongated rectangular shape forming a generally rectangular opening, and an internal stop structure that extends inwardly from the outer body structure into the generally rectangular opening, the back stop surface of the front daft gear contacting the intermediate stop member internal stop structure during a buff condition of the draft gear assembly, the front stop surface of the back draft gear contacting the yoke intermediate stop during a buff condition of the draft gear assembly, and the back stop surface of the back draft gear contacting the draft sill rear stops during a buff condition of the draft gear assembly.

6. The draft gear assembly of claim 1, wherein upon a full buff force being applied to the draft gear assembly, the front resilient member and the back resilient member are compressed about 1.5 inches.

7. A draft gear assembly for use with railway freight cars, the draft gear assembly having a front end and a back end and comprising:

a yoke having a rear wall and being shiftable between a buff position, a neutral position, and a draft position, a coupler having a shank with a butt end, a front draft gear positioned in operative connection with the coupler shank butt end, the front draft gear including a front resilient member, a back draft gear positioned adjacent the rear wall of the yoke, the back draft gear including a back resilient member an intermediate stop member between the front draft gear and the back draft gear, a yoke intermediate stop of the yoke between the front draft gear and the back draft gear, the yoke intermediate stop being engaged with the front draft gear and the back draft gear with the yoke in the neutral position thereof, the front resilient member and the back resilient member being compressible, such that upon a buff load being applied to the coupler, the coupler shank butt end compresses the front draft gear and the yoke intermediate stop compresses the back draft gear to share the buff load.

8. The draft gear assembly of claim 7, further comprising a draft sill having front stops, the front draft gear including a front stop surface for contact with the draft sill front stops, the draft sill having rear stops, the back draft gear including a back stop surface for contact with the draft sill rear stops, the front draft gear front stop surface contacting the draft sill front stops during a draft condition of the draft gear assembly, and the back draft gear back stop surface contacting the draft sill rear stops during a buff condition of the draft gear assembly.

9. The draft gear assembly of claim 7, wherein:

the front draft gear including a back stop surface contacting the intermediate stop member during a buff condition of the draft gear assembly, the back gear includes a front stop surface, and the yoke intermediate stop contacting the back draft gear front stop surface during a buff condition of the draft gear assembly.

10. The draft gear assembly of claim 7 wherein:

the front and back draft gears are compressed during a buff condition with a buff force being applied to the front draft gear by contact with the coupler butt end, and the buff force being applied to the back draft gear by contact with the yoke intermediate stop, such that the front and back resilient members being compressed during the buff condition such that a total compressive strength of the front resilient member and the back resilient member is the compressive strength of the front resilient member added to the compressive strength of the back resilient member.

11. The draft gear assembly of claim 8, wherein:

the intermediate stop member comprises an outer body structure of a generally elongated rectangular shape forming a generally rectangular opening, and an internal stop structure that extends inwardly from the outer body structure into the generally rectangular opening, the front draft gear including a back stop surface contacting the intermediate stop member internal stop structure during a buff condition of the draft gear assembly, the back draft gear includes a front stop surface contacting the yoke intermediate stop during a buff condition of the draft gear assembly, and the back draft gear back stop surface contacting the draft sill rear stops during a buff condition of the draft gear assembly.

12. The draft gear assembly of claim 7, wherein upon a full buff force being applied to the draft gear assembly, the front resilient member and the back resilient member are compressed about 1.5 inches.

* * * * *